US005779578A

United States Patent [19]

Calandro

[11] Patent Number: 5,779,578

[45] Date of Patent: Jul. 14, 1998

[54] PRESENTATION FOOTBALL CONSTRUCTION

[76] Inventor: Christopher John Calandro, 4524 Sarasota Dr., The Colony, Tex. 75056

[21] Appl. No.: 738,471

[22] Filed: Oct. 28, 1996

[51] Int. Cl.[6] ..... A63B 41/08

[52] U.S. Cl. ..... 473/599

[58] Field of Search ..... 473/570, 597, 473/598, 599, 603, 604, 605, 607, 600, 608, 609, 614; 40/327

[56] References Cited

U.S. PATENT DOCUMENTS

| | | | |
|---|---|---|---|
| 1,604,044 | 10/1926 | Hart | 473/607 |
| 2,653,818 | 9/1953 | Tebbetts, Jr. et al. | 473/604 |
| 3,091,562 | 5/1963 | Berlepsch, Jr. et al. | 473/604 |
| 3,863,923 | 2/1975 | Anderson | 473/604 |
| 4,337,944 | 7/1982 | Massino | 473/597 |
| 5,320,345 | 6/1994 | Lai et al. | 473/603 |
| 5,345,053 | 9/1994 | Ratner et al. | 40/327 |

*Primary Examiner*—Steven B. Wong
*Attorney, Agent, or Firm*—Sidley & Austin

[57] ABSTRACT

A presentation football (10) is disclosed which includes a vinyl panel (22) with the artwork (24) placed thereon by a resin printer. The vinyl panel 22 is adhesively secured to one of the football panels (12, 14, 16, 18) forming the football itself. The edges of the vinyl panel and football panels are sewn together with the football turned inside out. Once the sewing is completed, the football is turned inside out to form the football.

15 Claims, 1 Drawing Sheet

PRESENTATION FOOTBALL CONSTRUCTION

BACKGROUND OF THE INVENTION

The market for presentation footballs has been a growing one recently. These footballs are usually the same size as regulation footballs used in the game itself. The presentation football also usually has the look and feel of a regulation football. An important aspect of the presentation football is the artwork presented thereon. A particular style of presentation football may be sold in large quantities. For example, if the football has a team logo thereon, a fan of that team would be the typical purchaser. However, a considerable market exists in the creation of customized, if not individual, presentation footballs to commemorate a specific game or player. For example, a star football player may be rewarded a presentation football with artwork specific to that player or a game that player has just been in by a grateful franchise.

Since the presentation football is not purchased for actual use, its essential reason for existence, the artwork thereon, is very critical to its marketability. A need exists for a method of printing and the resulting improved presentation football which overcomes the shortcomings of prior designs, which includes lifting off of the artwork from the face of the football, fading or discoloration of the artwork, and an initial inability in the first instance to print vibrant and dynamic colors. It is also important to eliminate the need for set-up charges such as is necessary in silk screen printing.

SUMMARY OF THE INVENTION

In accordance with one aspect of the present invention, a presentation football is provided which includes a vinyl panel having artwork printed thereon by a resin printer and a plurality of football panels to form the presentation football. In accordance with another aspect of the present invention, the vinyl panel has an adhesive backing and is adhesively secured to one of the football panels. In accordance with another aspect of the present invention, each of the vinyl and football panels have internal edges, each of said football panels being secured to the adjacent football panels at abutting internal edges, the internal edges of the vinyl panel being secured to the internal edges of the football panel to which it is adhered and also to the adjacent football panels so that the edges of the vinyl panel are not exposed.

In accordance with another aspect of the present invention, a method of making a presentation football is provided. The method includes the step of printing artwork on a vinyl panel using a resin printer. The vinyl is secured to a football panel. A plurality of football panels are secured together at their internal edges to form the football.

BRIEF DESCRIPTION OF THE DRAWINGS

A more complete understanding of the invention and its advantages will be apparent from the following detailed description when taken in conjunction with the accompanying drawings in which.

DETAILED DESCRIPTION

Figure 2:
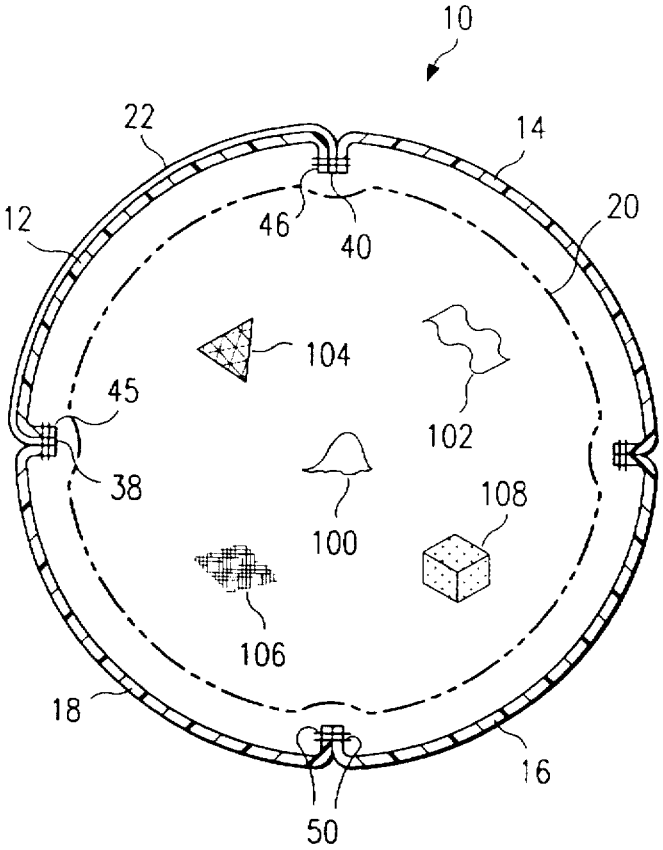
FIG. 2 is a cross section through the presentation football illustrating the vinyl and football panels secured together.

Referring now to the drawings, wherein like reference characters designate like or corresponding parts throughout the several views, and in particular to FIG. 2, there is illustrated a presentation football 10 forming a first embodiment of the present invention. A presentation football is generally not intended to ever be used in an actual football game. Often, it is the same size as a regulation football. However, it can be smaller or larger than a regulation football. However it is generally constructed of materials and in a style similar to a regular football.

As shown in FIG. 2, the presentation football 10 is formed of four football panels 12, 14, 16 and 18 sewn or otherwise secured together to form the traditional football shape. A bladder 20 is provided within the cavity formed by the football panels for inflating the ball to the desired pressure. The football panel 12 has adhered to the exterior surface thereof a vinyl panel 22 which has artwork 24 on the exposed surface thereof. The artwork may be a team logo, the name of a player, the score of an important football game, a photograph and the like. As will be described in greater detail hereafter, the artwork is printed on the final panel by a resin printer 42.

Figure 1:
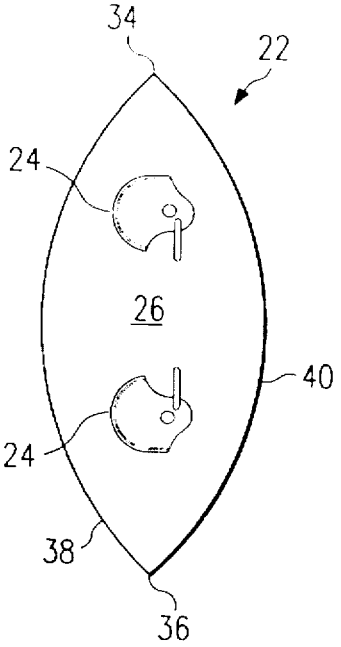
FIG. 1 is a plan view of a vinyl panel with artwork thereon forming a portion of the presentation football of the present invention.
Figure 3:
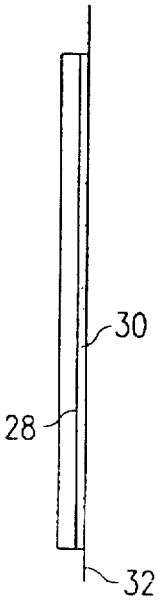
FIG. 3 is a side view of the vinyl panel illustrating the adhesive backing thereon.

With reference to FIG. 1 and FIG. 3, the vinyl panel 22 can be seen to be formed of a self-adhesive high performance vinyl, preferably about 2 mils thick. The exposed side 26 of the vinyl panel 22 is receptive to artwork 24 printed thereon by a resin printer. The interior surface 28 has a layer of adhesive 30 formed thereon which adheres the vinyl panel 22 to football panel 12. An adhesive backing sheet 32 protects and covers the adhesive 30 until the vinyl panel 22 is ready to be adhered to the football panel 12. As is typical, the backing sheet 32 is made of a material to allow ready removal from the adhesive 30 when desired.

The vinyl panel 22 is cut from flat stock into the shape of the football panels as illustrated in FIG. 1. The vinyl panel has ends 34 and 36 and curved side edges 38 and 40.

Figure 4:
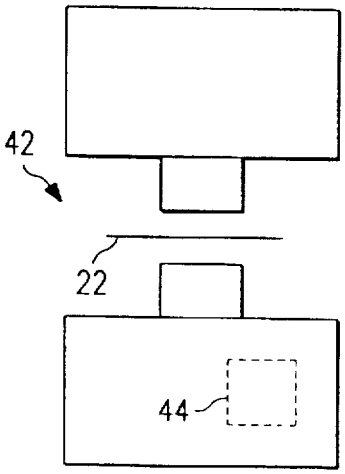
FIG. 4 is a side view of a resin printer utilized to print the artwork on the vinyl panel.

Before adherence to the football panel 12, the artwork is printed on the vinyl panel 22 by a resin printer 42. The artwork is designed on a template created in a computer 44. The computer 44 forms part of the resin printer 42, as seen in FIG. 4. Resin printers suitable for this operation are sold by Fargo Electronics of Eden Prairie, Minn. as Model 310S; Roland Digital Group of Irvine, Calif. as Model ColorCAMM; Western Graphtec of Irvine, Calif. as Model GC1300; and Gerber Scientific Products of Manchester, Conn. as Model Edge.

After the artwork 24 is printed on the vinyl panel 22, the backing sheet 32 is removed and the vinyl panel is placed on the exterior surface of the football panel 12, which itself is cut from a flat stock of suitable material, such as vinyl or leather, in the same basic shape and dimensions as the vinyl panel 22, and which has curved edges 45 and 46. A squeegee is preferably used to firmly apply the vinyl panel 22 on the football panel 12 to remove any air bubbles and pockets between the two materials so that the vinyl panel is securely adhered to the football panel 12 by the adhesive 30. While a resin printer is suggested, other suitable printers could be used.

With the vinyl panel 22 adhered to the football panel 12, the football panels 12–18 are formed into the presentation football 10 itself. The curved edges of each of the panels are turned inwardly, as seen in FIG. 2, and secured to the inwardly turned edges of the adjacent panel by sewing with thread 50 or other securing techniques, such as gluing, clipping, heat bonding, and the like. The assembly of the football is typically done inside out from the final shape as shown in FIG. 2 so that the edges are exposed to facilitate sewing or otherwise securing the edges together. One of the panels 12–18 will have a split therein and lacing as with a regular football. The football 10 is turned inside out through this split.

The edges 38 and 40 are sewed or otherwise secured between the edges 45 and 46 of football panel 12 and the adjacent edges of football panels 14 and 18 so that they are hidden from exterior the football and also provide another mechanism to secure the vinyl panel on the football panel 12 in addition to the adhesive. Also, the dimensions of the vinyl panel 22, if larger than the football panel 12, is of little significance because any overlapping vinyl will ultimately be on the inside of the football and unseen.

After the football panels have been secured together, the football is then turned right side out into the configuration as shown in FIG. 2. This is preferably done by hand to avoid tearing of the vinyl panel 22 and the artwork 24 thereon. However, it may be possible to design automated machinery to perform this function.

A bladder 20 is then placed within the football through the split in one of the panels 12–18. The bladder has an air valve passing through a precut hole in one of the football panels to allow the insertion of an inflation needle. The football can then be laced and inflated to the desired pressure, typically 13 psi. It remains only then to package and ship the completed presentation football 10 to the customer.

In addition to, or in substitution for, bladder 20, the football can be filled with a filler. The filler can, for example, be sand, paper, recycled material, material similar to that used in stuffed animals, a rigid core and the like. The filler material can be selected depending on cost and the application desired.

Mass personalization of display or presentation footballs has never been successfully achieved before mainly because the technology would not allow for cost effective production. Silkscreening has been widely used in the past but is not feasible for small runs due to high set up costs. The present invention provides a process and apparatus allowing the printing of decorative footballs with a permanent, premium quality impression. Advances in resin ink imprinting have aided this new process of printing presentation footballs with exceptional quality. It has been found that the properties of the resin artwork does not adversely affect the football manufacturing process. Even so, it has been found to be important that the footballs are turned inside out manually. The printed image is durable and will withstand moisture and abrasion. Because of flexibility of resin print process, there are virtually no limits to what artwork can be created. In fact, the above process is truly a new football manufacturing process and could be used to make regulation footballs as well.

The process of the present invention can also be used to place panel images on a football after the football is made. The process can utilize a mold in the shape of an inflated football panel which transfers images to the football.

Although a single embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing from the scope and spirit of the invention.

I claim:

1. A presentation football comprising:

a vinyl panel having artwork printed thereon by a resin printer with the artwork printed on the vinyl panel when the vinyl panel is in a flat shape;

a plurality of football panels;

adhesive bonding the vinyl panel to one of said football panels; and the football panels being secured together to form a football with the vinyl panel having a shape configured to the shape of the football.

2. The presentation football of claim 1 wherein each of said panels has edges, the edges of each of said panels being secured to the edges of the adjacent panel.

3. The presentation football of claim 2 wherein threads secure the panels together at their edges.

4. The presentation football of claim 1 further including an air bladder to inflate the football.

5. The presentation football of claim 1 wherein the vinyl panel has dimensions which are at least equal to the dimensions of said football panel to which it is secured, each of said panels having edges secured to the edges of adjacent panels, the edges of the vinyl panel and said one of the football panels to which it is secured thereby being secured to the edges of adjacent football panels.

6. The presentation football of claim 1 wherein the football is filled with a filler.

7. The presentation football of claim 6 wherein the filler is selected from the group consisting of:

sand, paper, recycled material and a rigid core.

8. A method for manufacturing a presentation football, comprising the steps of:

forming a vinyl panel;

printing artwork on the vinyl panel with a resin printer when the vinyl panel is in a flat configuration;

securing the vinyl panel to one of a plurality of football panels; and securing the panels together to form the football, the vinyl panel being in a curved configuration in the football.

9. The method of claim 8 further comprising the step of removing a backing paper from adhesive on the vinyl panel and securing the vinyl panel to the football panel with the adhesive.

10. The method of claim 8 further comprising the steps of securing each of said football panels to an adjacent football panel at the edges thereof.

11. The method of claim 10 wherein the method further includes the step of securing the football panels at the edges thereof with the edges exposed and then manually turning the panels inside out to form the football.

12. The method of claim 8 further including the step of inserting an air bladder to inflate the presentation football.

13. The method of claim 8 further comprising the step of filling the presentation football with a filler.

14. The method of claim 13 wherein the step of filling the football includes the step of filling the football with filler selected from the group consisting of sand, paper, recycled material and a rigid core.

15. The method of claim 8 further comprising the step of squeegeeing the vinyl panel onto the football panel to remove air bubbles and pockets therebetween.

* * * * *